US008132380B2

(12) United States Patent
Wilkes, Jr.

(10) Patent No.: US 8,132,380 B2
(45) Date of Patent: Mar. 13, 2012

(54) COMPLIANT TRIM FOR CONCRETE SLABS

(76) Inventor: Robert David Wilkes, Jr., League City, TX (US)

( * ) Notice: Subject to any disclaimer, the term of this patent is extended or adjusted under 35 U.S.C. 154(b) by 43 days.

(21) Appl. No.: 12/581,189

(22) Filed: Oct. 19, 2009

(65) Prior Publication Data

US 2010/0095620 A1 Apr. 22, 2010

Related U.S. Application Data

(60) Provisional application No. 61/106,614, filed on Oct. 20, 2008.

(51) Int. Cl.

| | |
|---|---|
| ***E04B 1/68*** | (2006.01) |
| ***E04B 1/62*** | (2006.01) |
| ***E04F 15/14*** | (2006.01) |
| ***E04F 15/22*** | (2006.01) |

(52) U.S. Cl. ..... 52/396.04; 52/393; 52/396.03; 52/396.05; 52/396.06

(58) Field of Classification Search ..... 52/465, 52/396.04, 273, 459, 461, 463, 464; 404/67–69
See application file for complete search history.

(56) References Cited

U.S. PATENT DOCUMENTS

| | | | | | |
|---|---|---|---|---|---|
| 2,156,681 | A | * | 5/1939 | Dewhirst et al. | 404/65 |
| 3,308,726 | A | * | 3/1967 | Dreher | 404/67 |
| 3,320,706 | A | * | 5/1967 | Elliott et al. | 52/393 |
| 3,411,260 | A | * | 11/1968 | Dill | 52/396.03 |
| 3,413,900 | A | * | 12/1968 | Crone | 404/48 |
| 3,469,510 | A | * | 9/1969 | Worson | 404/69 |
| 3,521,528 | A | * | 7/1970 | Wangerow | 404/69 |
| 3,575,094 | A | * | 4/1971 | Hewitt et al. | 404/65 |
| 3,604,169 | A | * | 9/1971 | Smith | 52/396.04 |
| 3,732,788 | A | * | 5/1973 | Brown | 404/64 |
| 3,871,787 | A | * | 3/1975 | Stegmeier | 404/48 |
| 3,896,597 | A | * | 7/1975 | Deason | 52/396.02 |
| 3,923,411 | A | * | 12/1975 | Berghman | 404/64 |
| 4,129,967 | A | * | 12/1978 | Barlow | 52/15 |
| 4,362,427 | A | * | 12/1982 | Mass et al. | 404/64 |
| 4,461,131 | A | * | 7/1984 | Pressell | 52/395 |
| 4,522,413 | A | | 6/1985 | Nicholas | |
| 4,699,540 | A | * | 10/1987 | Gibbon et al. | 404/49 |
| 4,708,517 | A | * | 11/1987 | Nicholas et al. | 404/64 |
| 4,743,036 | A | * | 5/1988 | Nicholas | 277/645 |
| 4,841,704 | A | * | 6/1989 | Jarrell | 52/396.02 |
| 4,913,576 | A | | 4/1990 | Grant, Jr. | |

(Continued)

FOREIGN PATENT DOCUMENTS

| | | | |
|---|---|---|---|
| JP | 09025607 | * | 1/1997 |

OTHER PUBLICATIONS

Slab Gasket, www.slabgasket.com, copyright notice 2008.

(Continued)

*Primary Examiner* — Mark Wendell

(57) ABSTRACT

A compliant trim for use between concrete slabs is disclosed, intended for the replacement of wood commonly used for formwork to divide concrete slabs. The compliant trim is easily inserted into the space cleared of wood, will not migrate deeper into the space, and is therefore independent of the depth of the cleared space beyond a minimum needed for installation. Additionally, the compliant trim lies flush or below the surface of slabs which have edge radii, making it relatively unaffected by foot traffic, vehicles, and the like. The trim may be extruded, may be manufactured from recycled materials, and remains compliant to allow for joint expansion and contraction.

13 Claims, 3 Drawing Sheets

U.S. PATENT DOCUMENTS

| | | | | |
|---|---|---|---|---|
| 5,116,653 | A | 5/1992 | Frandina | |
| 5,343,662 | A * | 9/1994 | Nelson | 52/208 |
| 5,375,386 | A * | 12/1994 | Goad | 52/396.03 |
| 5,531,455 | A * | 7/1996 | Calixto | 277/646 |
| 5,888,017 | A | 3/1999 | Corrie | |
| 5,956,912 | A * | 9/1999 | Carter et al. | 52/396.02 |
| 6,219,982 | B1 * | 4/2001 | Eyring | 52/396.04 |
| 6,293,066 | B1 * | 9/2001 | Lohrey | 52/396.08 |
| 6,550,202 | B2 * | 4/2003 | Sandoz et al. | 52/352 |
| 6,550,205 | B2 * | 4/2003 | Neuhofer, Jr. | 52/464 |
| 6,588,165 | B1 * | 7/2003 | Wright | 52/506.05 |
| 6,609,341 | B2 * | 8/2003 | Maylon et al. | 52/367 |
| 6,948,716 | B2 * | 9/2005 | Drouin | 277/606 |
| 2002/0000072 | A1 * | 1/2002 | McGrath et al. | 52/466 |
| 2008/0115440 | A1 | 5/2008 | Fortney et al. | |
| 2009/0145070 | A1 * | 6/2009 | Linn et al. | 52/465 |

OTHER PUBLICATIONS

Gap Armour, www.gaparmour.com, copyright notice 2011.

* cited by examiner

COMPLIANT TRIM FOR CONCRETE SLABS

CROSS-REFERENCE TO RELATED APPLICATION

This application claims the benefit of U.S. provisional application 61106614, filed on Oct. 20, 2008.

STATEMENT REGARDING FEDERALLY FUNDED RESEARCH OR DEVELOPMENT

Not applicable

BACKGROUND OF THE INVENTION

1. Field of the Invention

A compliant trim for use between concrete slabs is the subject of this invention. It is intended for the repair and replacement of wood commonly used as formwork to divide concrete slabs during their installation.

2. Description of Prior Art

In residential construction of driveways and sidewalks, wood is typically used for the formwork. This formwork is often left between individual slabs after the external formwork is removed. The wood is subject to rot and decay, even if a rot-resistant variety is used such as cedar. Additionally, the wood holds moisture and collects dirt and debris in the space between the wood and the concrete, leading to weed growth between the slabs. This condition requires repeated application of weed-killing chemicals, and makes the concrete joint vulnerable to freeze-thaw cycles.

Current art replaces rotted or damaged wood formwork with a viscous liquid sealant that hardens to a rubber-like consistency. Such a material is disclosed by Frandina, U.S. Pat. No. 5,116,653. This type of material is typically sold in tubes which are dispensed by hand chalk gun into a joint that has been cleared of the wood formwork. This repair method is labor-intensive, messy, costly, and the finished product is greatly dependent on the skill of the installer. The quantity of sealant needed for a given job is also difficult to assess in advance, as the volume of the cavity between the slabs is difficult to determine. This often results in repeat visits to the point of purchase, either for the purchase of additional quantities, or the return of unused product. Additionally, this method must cure, and it must remain undisturbed for some time before its final properties are developed.

Another approach to this problem in the current art seeks to plug this gap with a preformed compliant material. Gibbon et al, U.S. Pat. No. 4,699,540, disclose a compliant tube-shaped element which is anchored with a liquid sealant. This method requires a specific shape be present in the slab edges. This shape is not typically cast into slab edges; it can be created, however, if specific material is removed to form the appropriate cavity for installation. This amount of preparation makes this prohibitively expensive for the repair and replacement of residential driveways and sidewalks due to the equipment and labor required to cut and remove cured concrete. This method also has the same disadvantages as pure liquid sealants, in that it will be potentially messy and it's final appearance dependent on the skill of the installer.

Corrie, U.S. Pat. No. 5,888,017, discloses a compliant sealing element intended for interior flooring which can be placed in a simple gap. While avoiding the complexity of Gibbon et al, this expansion joint cap is proud of the surface, and as such, must be made sufficiently strong to accommodate the automobile and foot traffic without accumulating damage. It must also be thin enough to avoid becoming a trip hazard. These competing needs make the material selection rather difficult for the application of repairing driveways. Additionally, the expansion joint cap is designed for application on slab edges without significant edge radii. Residential driveways typically have an edges radius around each slab.

The current art also includes a hollow trapezoidal section fabricated from extruded vinyl. While the trapezoidal cross-section is expressly intended for the repair of driveways and sidewalks, the trapezoidal cross-section has several limitations. The trapezoidal cross section is difficult to install and maintain to a consistent depth, requiring that the joint be filled with sand or other filler material prior to the installation of the trapezoidal section. The trapezoidal cross-section also has limited compliance to variations in joint width, which increases the effort of installation and may necessitate the use of several different extrusion widths to accommodate variations found in typical installations. Additionally, the amount of material used to produce this cross-section is inefficient, making the weight and bulk of the raw material difficult to handle.

The current art has a common susceptibility to weed and plant growth. This susceptibility stems from a very low volume vertical space between the expansion joint material and the slab. In the case of liquid sealants, this space is formed when the cured sealant delaminates from the slab, either due to poor adhesion, shrinkage of the sealant, or excessive motion of the slabs tending to increase the gap beyond the capability of the sealant to comply. In the case of wooden expansion joints, this condition exists from the moment of installation. This space is filled relatively quickly with particulate, and is exploited by plant roots to access moisture below the expansion joint. Because the surface of the slab is rough and sealing cannot be relied upon, inventions such as Wangerow et al, U.S. Pat. No. 3,521,528, and Nicholas, U.S. Pat. No. 4,522,413 illustrate a geometry with little volume between the expansion joint material and the slab. These small gaps will quickly fill with particulate, and these inventions are therefore poor for the purpose of inhibiting plant/weed growth.

BRIEF SUMMARY OF THE INVENTION

It is the purpose of the current invention to produce a repair at a fraction of the cost of liquid sealing methods, with greatly reduced installation effort, consistent installation, and with no cure time. A particular area to be repaired with the present invention is also easily assessed, as it replaces wood formwork lineal foot for lineal foot. Additionally, the present invention can be easily removed and put back in place, should the need arise to place wires or irrigation lines across the concrete at some point in the future. This is not possible with the current art of liquid sealants.

It is also the purpose of the current invention to produce a product which incorporates features to limit the insertion depth, obviating the need to pre-fill or similarly prepare an empty expansion joint. The current invention also seeks to install flush or below the concrete surface, greatly reducing its vulnerability to damage and wear. An additional purpose of the current invention is to produce a product that is more easily installed than the current art, with greatly reduced sensitivity to joint dimensions and variations. It is also an important aim of this invention to reduce the cost of replacement of rotted wood formwork to below that of the current art by allowing the use of a material-efficient cross-section and allowing the use of recycled materials due to the reduced demands on material properties that the current invention brings.

The current invention is a compliant trim and expansion joint for concrete slab joint repair, consisting of a substantially constant cross-section with integral anchoring means, a means to limit the depth of said trim, and a means to provide a finished, decorative surface flush or below the surface of said concrete slab. Said trim is preferably produced by extrusion, and lends itself well to the use of recycled rubber products, recycled polymer products, and blends thereof for its manufacture. Use of recycled materials results in reduced production costs, as well producing an environmentally friendly product.

The slabs to be repaired with this invention typically have edge radii on both sides of the wooden formwork; one half inch radius is nominal. The joint is also characterized by substantially parallel faces below said radius, which was initially occupied by wood. This region is the most dimensionally reliable, and is exploited for use in anchoring said trim. Said anchoring means holding said trim in place is compressively wedged between the two slabs in this area between said parallel faces. Said anchoring means is designed to resist removal, and the force to insert said trim is substantially less than the force to remove it.

The current invention seeks to minimize weed and plant growth in two ways: Limiting the quantity of particulate in the joint itself by providing a seal as close to the surface as possible, and making it difficult to accumulate sufficient particulate to sustain plant life.

The present invention provides a seal in the region between the rounded edges of the slabs. This position, being much closer to the surface than the first seal in inventions by Dewhirst et al, U.S. Pat. No. 2,156,681, Wangerow and Nicholas, minimizes the depth and volume of foreign material that can accumulate above and between the expansion joint and the adjacent concrete slabs.

Inhibiting weed penetration is accomplished by a reduction of trapped soil within the expansion joint, as well as blocking access to moisture beneath the slab. The present invention provides a surface seal, below which are compliant secondary seals. These seals block access to soil beneath the slab, and inhibit the introduction of debris and dirt into the joint. Between these secondary seals relatively large empty volumes are present. The volumetric capacity of the present invention requires a large amount of debris to accumulate in order to appreciably fill the space and create a continuous path, which will take correspondingly longer to accumulate than the current art.

DETAILED DESCRIPTION OF THE INVENTION

Figure 1:
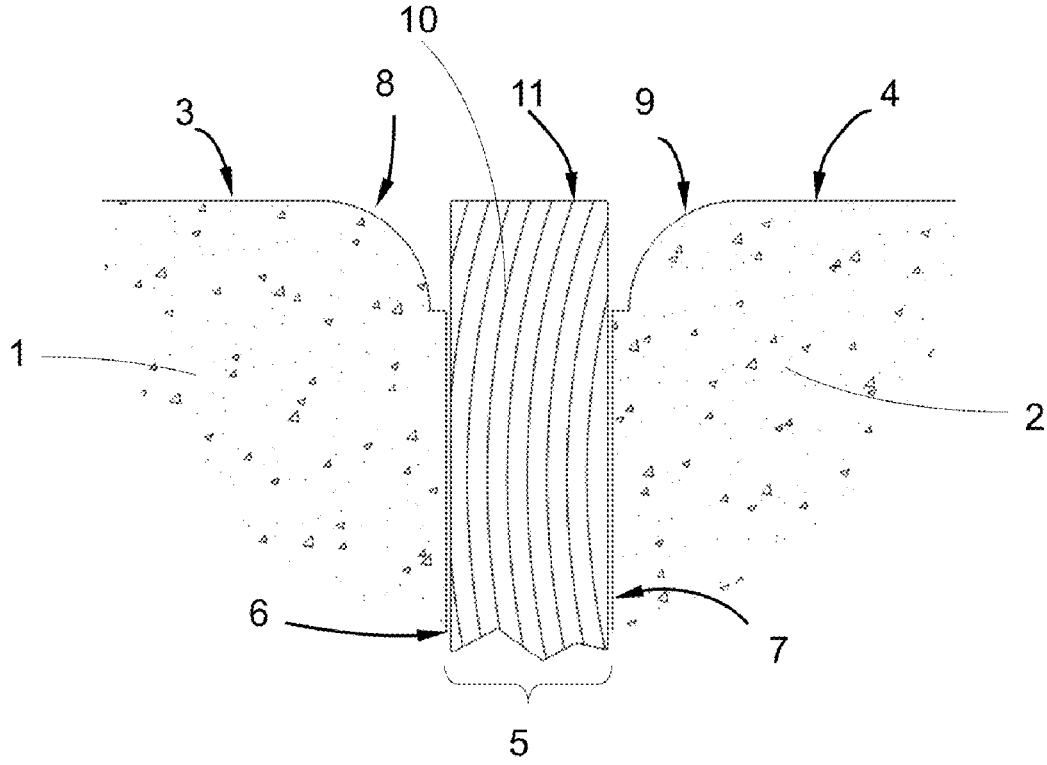
FIG. 1 shows a cross-section of a concrete expansion joint, with a wooden formwork

The claimed invention is intended to replace wooden formwork which was placed between adjacent slabs at the time said slabs were poured. A cross-section of said formwork is shown in FIG. 1. Adjacent slabs 1 and 2 are characterized by an exposed surface 3 and 4, a gap 5 with substantially parallel surfaces 6 and 7, and an edge radius 8 and 9. Said formwork 10 has a surface 11 which is substantially coplanar to said exposed slab surface 3 and 4. In fact, formwork surface 11 is generally used to establish exposed surface 3 and 4 during the installation of said slabs 1 and 2.

Figure 2:
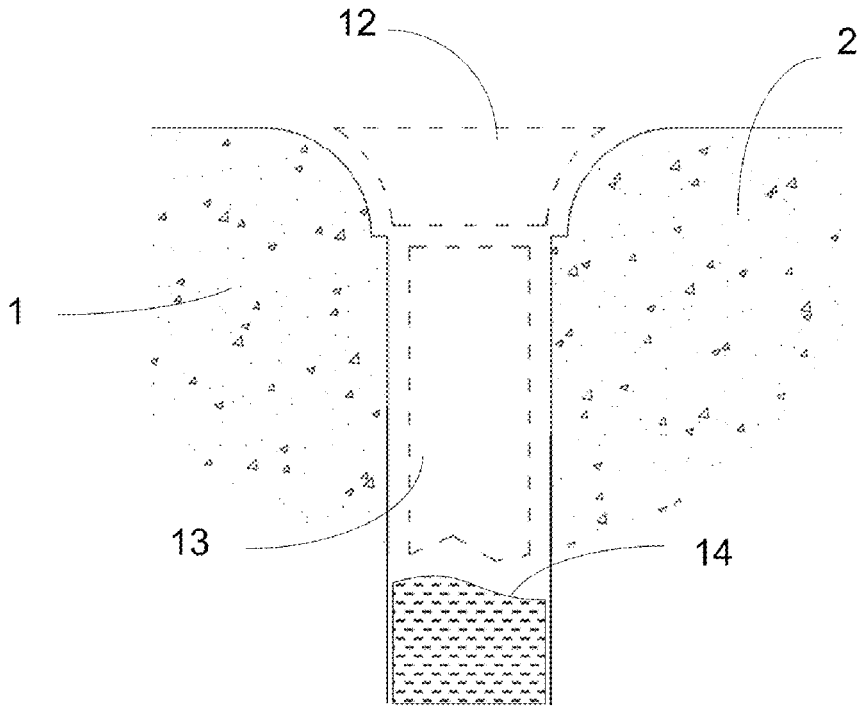
FIG. 2 shows a cross-section of an empty joint between adjacent concrete slabs, divided in two volumetric zones

Once said wooden formwork 10 has been removed, two distinct zones can be defined. Referring to FIG. 2, the first of said zones lies at the surface, between the edge radius 8 and 9 of said slabs 1 and 2. This radius zone 12 is further defined by an upper boundary substantially co-planar to said exposed surface 3 and 4, and a lower boundary at the termination of edge radius 8 and 9. The second zone lies beneath said radius zone 12. A parallel zone 13 extends from said radius zone, between said parallel surfaces 6 and 7, to the surface of the soil 14. Said surface of the soil 14 may often contain remnants of wooden formwork 10.

The observation that two distinct and geometrically dissimilar zones are present in many slab joints is essential in understanding the subject of this invention. The claimed invention is a compliant trim, characterized by two elements: An anchoring means, and a depth limiting means. Said anchoring means generally occupies said parallel zone 13, employing an interference friction fit between said compliant trim and said parallel surfaces 6 and 7. Said depth limiting means occupies said radius zone 12, said depth limiting means being geometrically larger than said gap 5, and lacking sufficient compliance to be easily fit within said parallel zone 13.

Figure 3:
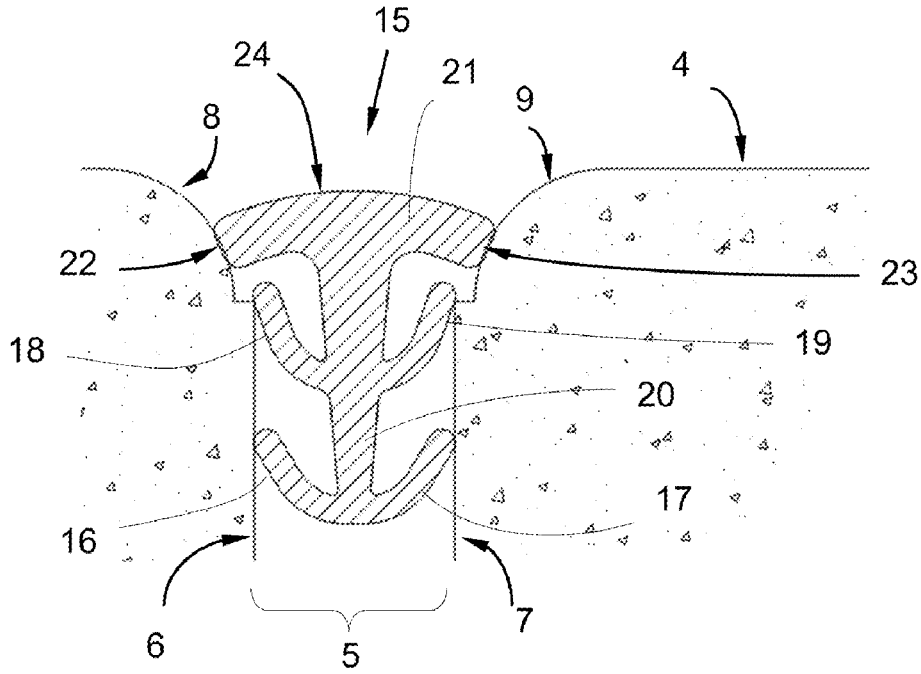
FIG. 3 shows a cross-section of a concrete expansion joint, with the beam arm embodiment of the compliant trim installed between adjacent concrete slabs

In the preferred embodiment, illustrated by FIG. 3, said compliant trim 15 is installed into said gap 5 after removal of said wooden formwork 10. Said compliant trim 15 is equipped with said anchoring means, comprised of compliant beams 16, 17, 18 and 19. Said compliant beams are connected at their proximal ends to a web 20, said compliant beams in contact with said parallel surfaces 6 and 7 at their distal ends once installed. Said web 20 lies substantially central to said gap 5, intersecting a cap 21, said cap acting as said depth limiting means. Said cap 21 is preferably comprised of a section of material defining an arc segment, dimensionally larger than said gap 5, preferably installed with depth limiting surfaces 22 and 23 in contact with edge radius 8 and 9. Said cap 21 also exhibits a decorative surface 24. In the preferred embodiment, said decorative surface 24 is flush or below the plane defined by surface 3 and 4 of said adjacent slabs 1 and 2.

Figures 4A, 4B, 4C:
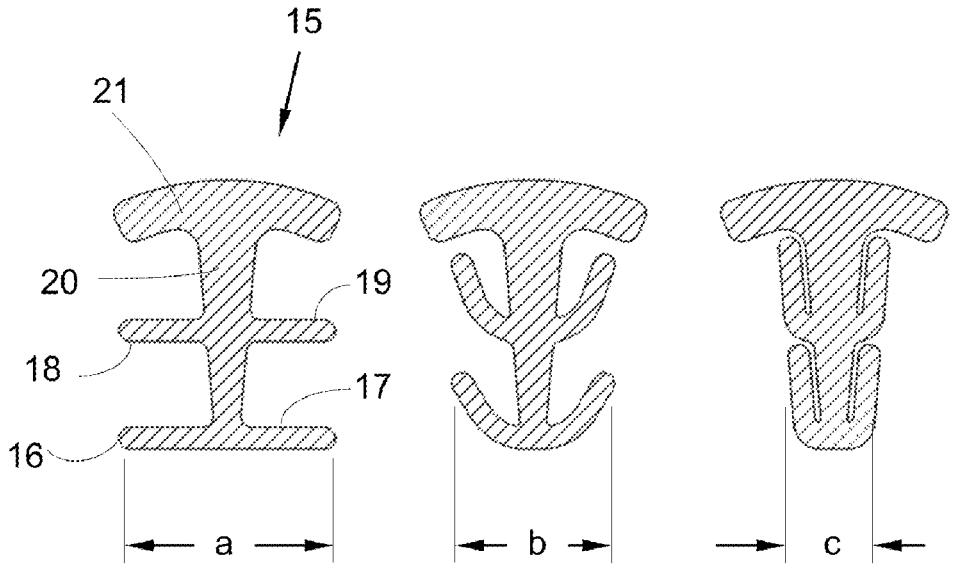
FIG. 4*a* shows the as-molded shape of the beam arm embodiment of the compliant trim
FIG. 4*b* shows the nominal installed configuration of the beam arm embodiment of the compliant trim
FIG. 4*c* shows the minimum width configuration of the beam arm embodiment of the compliant trim

FIGS. 4*a*, 4*b*, and 4*c* illustrate the various positions that said resilient beams 16, 17, 18 and 19 may take. FIG. 4*a* shows the as-molded configuration. As-molded beams are substantially perpendicular to said web 20, with a maximum width 'a', so as to maximize the size of gap 5 into which said compliant trim may be installed such that said resilient beams remain in contact with said gap surfaces 6 and 7. FIG. 4*b* illustrates said resilient beams in their nominal installed configuration; therefore, width 'b' is equivalent to said gap 5. The deflection bias of said resilient beams occurs during installation into said gap 5 at a relatively low force. Removal of said compliant trim 15 thusly installed requires that said resilient beams 16, 17, 18 and 19 buckle, and reverse their deflection bias. The force required to remove said resilient beams is therefore substantially greater that the force required to install them. FIG. 4*c* illustrates the minimum width 'c' of said compliant trim. The substantial change in width from the as-molded configuration 'a' to fully deflected 'c' gives said compliant trim a large variation in width of said gap 5 that said compliant trim may accommodate.

It is understood that many variations in the number, placement, and the direction with respect to said web 20 of resilient beams may effect the same result as the preferred embodiment. Additionally, variations in the beam aspect ratio may be employed, and remain within the sprit of the invention. Geometric variations in the shape of said cap 21 may also be made, such as to make said decorative surface 24 flat, or with any number of grooves, slots, or other textures, and still remain within the scope of this invention.

Figure 5:
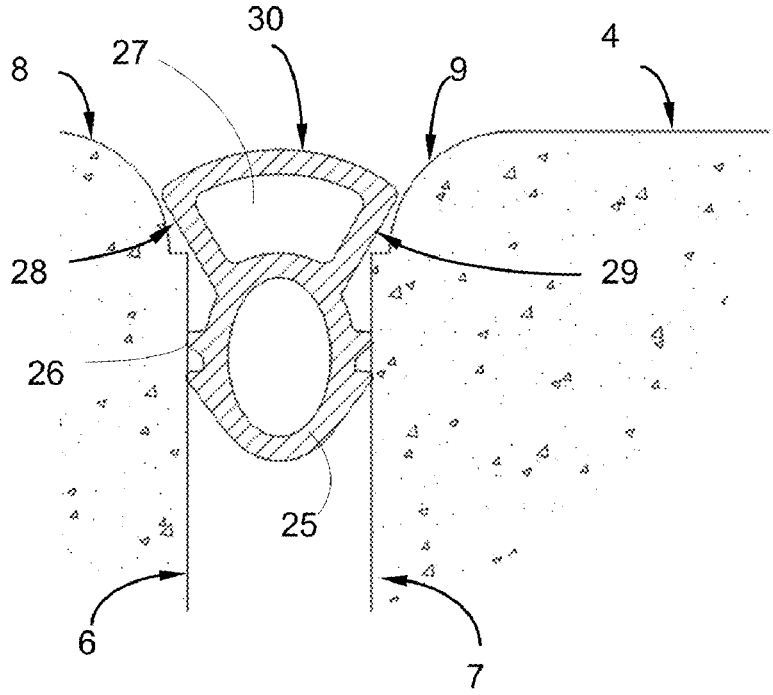
FIG. 5 shows a cross-section of a concrete expansion joint, with the tube embodiment of the compliant trim installed between adjacent concrete slabs

A second embodiment is illustrated by FIG. 5, in which said anchoring means of is a tubular element 25. Said tubular element 25 performs the same function as said resilient beams 16, 17, 18 and 19. Said tubular element 25 may also be equipped with a number of ridges 26, to increase the force required for removal of said compliant trim. Said depth limiting means is effected by the hollow arcuate section 27. Said hollow arcuate section 27 exhibits surfaces 28 and 29, which will preferably be in contact with edge radius 8 and 9 to establish the depth of said compliant trim. Said hollow arcuate section 27 also exhibits a decorative surface 30, identical in function to said decorative surface 24 in the preferred embodiment.

Figure 6A:
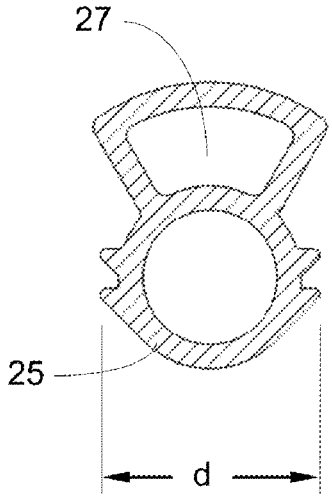
FIG. 6*a* shows the as-molded shape of the tube embodiment of the compliant trim
Figure 6B:
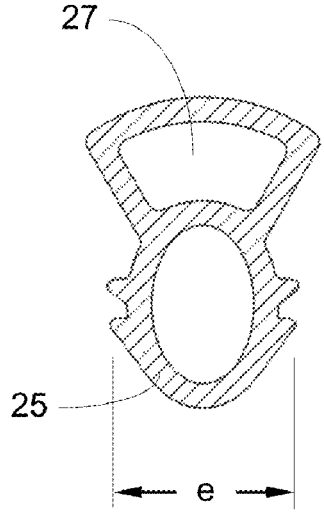
FIG. 6*b* shows the nominal installed configuration of the tube embodiment of the compliant trim
Figure 6C:
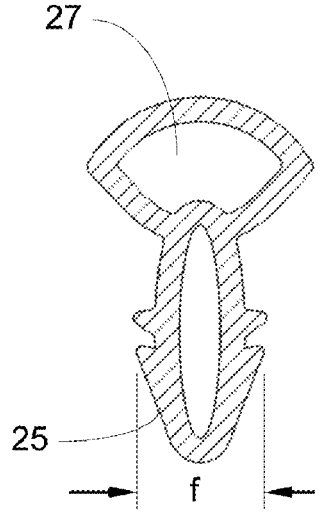
FIG. 6*c* shows the minimum width configuration of the tube embodiment of the compliant trim

Said anchoring means is performed by deflection or collapse of said tubular element 25. FIGS. 6*a*, 6*b*, and 6*c* illustrate the various states of deformation that said tubular element 25 will undergo during installation and use. FIG. 6*a* illustrates the as-molded configuration, with a width 'd'. Said width 'd' being larger than the anticipated gap 5. Upon installation, the geometry of FIG. 6*b* will result, with said tubular element 25 deformed into a generally oval shape of width 'e', said width 'e' being identical to said gap 5 when said compliant trim is installed into said parallel zone 13. Additionally, said tubular element 25 may be deformed more, into a shape shown in FIG. 6*c*, with a reduced width T. The difference in said width 'e' and said reduced width T giving said compliant trim the ability to install into a wide range of said gap 5, or to accommodate variability along the length in said gap 5.

The variation in the preferred embodiment and the second embodiment illustrates the degree of variability which may be made, and still remain within the spirit of the invention. Said depth limiting means prevents said compliant trim from migrating downward, such that the depth of soil surface 14 beyond a minimum required for installation is immaterial to the installation or future position of said compliant trim. Said depth limiting means remains substantially flush or below said exposed surface 3 and 4, minimizing wear, loading after installation, and reducing the possibility of a trip hazard for pedestrians. Said anchoring means may be effected by any number of beams, barbs, or collapsing geometric structures, so long as they operate substantially within said parallel zone 13, acting on said parallel surfaces 6 and 7.

What I claim is:

1. A system for the repair or replacement of expansion joints for concrete slabs, the system comprising:

concrete slabs comprising rounded edges above substantially parallel opposing faces, wherein the concrete slabs are separated so as to form a space between adjacent slabs;

a compliant trim occupying the space between said adjacent concrete slabs, wherein said compliant trim further comprising:

a depth limiting means; wherein said depth limiting means substantially occupies the volume between said rounded edges of said adjacent concrete slabs;

wherein said depth limiting means has a width which is larger than the distance between said parallel opposing faces of said adjacent concrete slabs and is located substantially flush or below the surface of said adjacent concrete slabs; and wherein said depth limiting means has a surface having a convex curvature such that when said compliant trim is placed between said adjacent concrete slabs, said surface of the depth limiting means maintains said convex curvature and minimizes the surface volume for the accumulation of particulate; and an anchoring means; wherein said anchoring means frictionally holds said compliant trim in place by acting on said parallel opposing faces of said adjacent concrete slabs.

2. The system for the repair or replacement of expansion joints for concrete slabs of claim 1, wherein the compliant trim is extruded from polymeric materials.

3. The system for the repair or replacement of expansion joints for concrete slabs of claim 2, wherein said polymeric materials are water and vapor permeable.

4. The system for the repair or replacement of expansion joints for concrete slabs of claim 2, wherein the compliant trim is made from recycled materials.

5. The system for the repair or replacement of expansion joints for concrete slabs of claim 4, wherein said recycled materials are at least partially composed of ground rubber.

6. The system for the repair or replacement of expansion joints for concrete slabs of claim 1, wherein said anchoring means comprises one or more beams, said beams are in contact with said parallel opposing faces of said adjacent concrete slabs.

7. The system for the repair or replacement of expansion joints for concrete slabs of claim 1, wherein said anchoring means is a hollow shape, substantially tubular, and deformed into a substantially oval shape when in direct contact with said parallel opposing faces of said adjacent concrete slabs.

8. The system for the repair or replacement of expansion joints for concrete slabs of claim 1, wherein said anchoring means comprises a vertical member and two or more beam-like projections at substantially right angles to said vertical member, said beam-like projections having an aspect ratio and produced from a material with sufficient strength to allow said beam-like projections to fold substantially parallel to and flat against said vertical member without permanent deformation.

9. The system for the repair or replacement of expansion joints for concrete slabs of claim 8 wherein said beam-like projections are arranged in pairs and are substantially mirrored across said vertical member, said pairs sufficiently spaced from adjacent pairs along said vertical member to allow said beam-like projections to fold substantially parallel to and flat against said vertical member without contacting said adjacent beam-like projections or said depth-limiting means.

10. The system for the repair or replacement of expansion joints for concrete slabs of claim 1, wherein said anchoring means is a hollow tubular section with a wall thickness and an inscribed void; wherein said wall thickness is at least several times less than an inscribed void size and produced from a material with sufficient strength to allow said hollow tubular section to collapse substantially flat along the vertical axis without permanent deformation.

11. The system for the repair or replacement of expansion joints for concrete slabs of claim 10, wherein said hollow tubular section is a circle, oval, or polygon.

12. The system for the repair or replacement of expansion joints for concrete slabs of claim 1, wherein said compliant trim may be removed and re-used without deleterious effects.

13. The system for the repair or replacement of expansion joints for concrete slabs of claim 1, wherein said compliant trim is up to 2 inches in width, and fashioned from an elastic material with a hardness of 40 to 90 on the Shore A scale.

* * * * *